US006500243B2

(12) United States Patent
Cook et al.

(10) Patent No.: US 6,500,243 B2
(45) Date of Patent: Dec. 31, 2002

(54) COMPRESSOR SYSTEM INCLUDING A SEPARATOR TANK WITH A SEPARATOR ELEMENT POSITIONED THEREIN

(75) Inventors: Roger Cook, Warrington (GB); Jason J. Link, Huntersville, NC (US); Elizabeth B. Warner, Huntersville, NC (US); Roger A. Fallows, Atherton (GB); Larry R. Stutts, Mooresville, NC (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 09/776,418

(22) Filed: Feb. 2, 2001

(65) Prior Publication Data

US 2002/0104296 A1 Aug. 8, 2002

(51) Int. Cl.[7] ..... B01D 50/00; B01D 35/30
(52) U.S. Cl. ..... 96/189; 55/337; 55/431
(58) Field of Search ..... 96/188, 189, 190; 55/337, 430, 431; 418/55.6, DIG. 1

(56) References Cited

U.S. PATENT DOCUMENTS

| | | | | |
|---|---|---|---|---|
| 1,581,371 A | | 4/1926 | Weisgerber | |
| 2,680,451 A | | 6/1954 | Hill | |
| 3,917,474 A | | 11/1975 | Heckenkamp et al. | |
| 4,113,450 A | * | 9/1978 | Goransson et al. | 55/337 |
| 4,690,759 A | * | 9/1987 | Mandy | 210/304 |
| 4,906,264 A | * | 3/1990 | Szymaszek et al. | 210/304 |
| 5,599,365 A | | 2/1997 | Alday et al. | |
| 5,669,154 A | * | 9/1997 | Bellomo | 34/71 |
| 5,676,717 A | * | 10/1997 | Cope et al. | 55/321 |
| 5,824,135 A | | 10/1998 | Minihan | |
| 5,846,271 A | | 12/1998 | Flynn et al. | |
| 5,958,108 A | | 9/1999 | Minihan | |
| 6,136,076 A | * | 10/2000 | Read | 55/480 |
| 6,387,142 B1 | * | 5/2002 | Pieciak et al. | 55/360 |

FOREIGN PATENT DOCUMENTS

| | | | | |
|---|---|---|---|---|
| JP | 36312341 A | * | 5/1988 | 96/189 |

* cited by examiner

*Primary Examiner*—Robert A. Hopkins
(74) *Attorney, Agent, or Firm*—Michael Best & Friedrich LLP

(57) ABSTRACT

An air compressor system having an air/oil separator for use with an air compressor, the air/oil separator including a separator tank having a side wall with an air exit port; a separator element hold down mechanism between the separator element and a lid mounted on the separator tank; and a separator element oil scavenge device which scavenges oil from the bottom of the separator element and passes the scavenged oil through the side wall of the separator tank. A method of replacing a separation element in a separation chamber of the air/oil separator including the steps of removing the separator element from the separation chamber without disconnecting the scavenge device attached thereto, and positioning a replacement separator element within the separation chamber, such that a scavenge device securely affixed thereto is caused to communicate with the side wall of the separator tank.

29 Claims, 5 Drawing Sheets

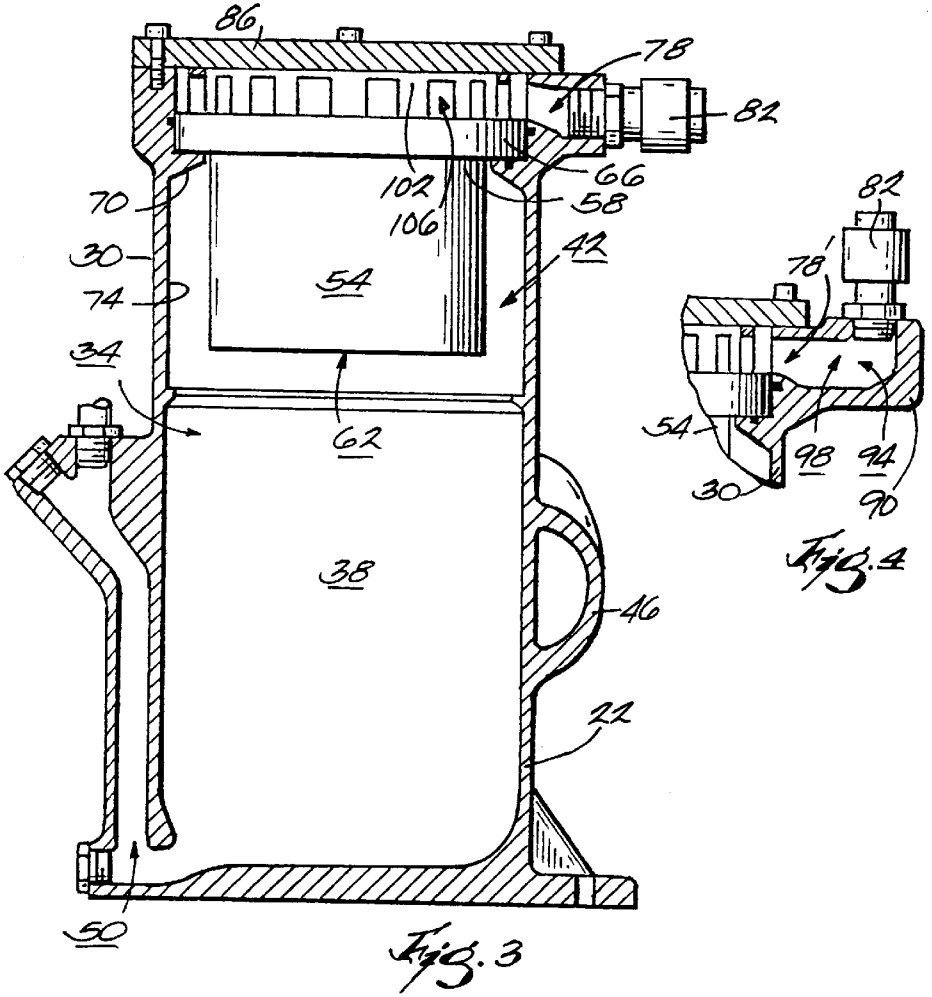
Fig. 3
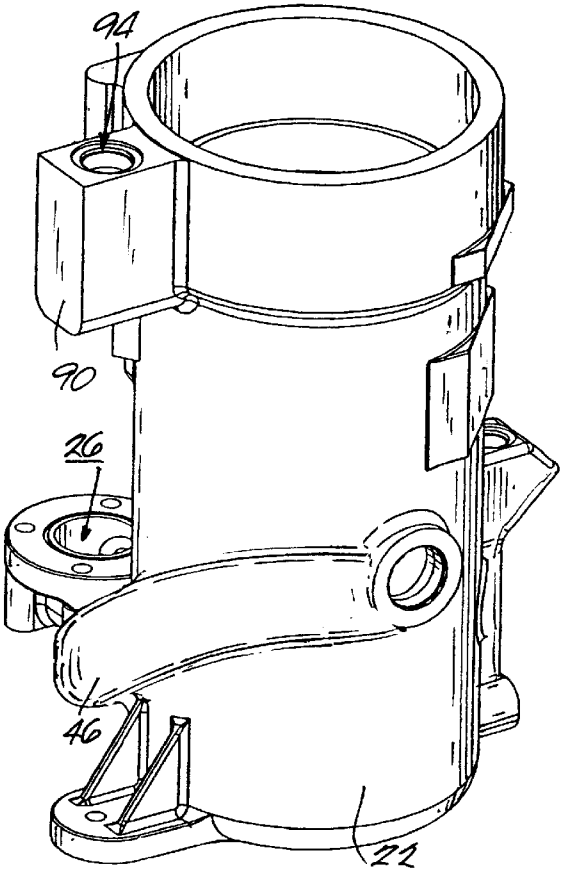
Fig. 4
Fig. 2

COMPRESSOR SYSTEM INCLUDING A SEPARATOR TANK WITH A SEPARATOR ELEMENT POSITIONED THEREIN

FIELD OF THE INVENTION

The present invention relates generally to a compressor system. More particularly, the present invention relates to an air/oil separator tank for use with an air compressor.

BACKGROUND OF THE INVENTION

In conventional air compressor systems air is compressed in a compression chamber or airend of a compressor, for example, by a set of rotary screws, and a lubricant, such as oil, is injected into the compression chamber and mixes with the compressed air. The oil is generally injected into the compression chamber for a number of reasons including cooling the air compressor system, lubricating bearings, balancing axial forces and sealing the rotary screws. Although using oil is essential for operating these types of air compressor systems, the oil must be removed from the stream of compressed air before the compressed air may be used downstream for pneumatic equipment and/or other tools.

In such conventional air compressor systems, the compressed air and oil mixture discharged from the airend of the compressor flows with a high velocity into a separator tank where the air and oil of the air/oil mixture are caused to separate. The separator tank is usually cylindrical and the air/oil mixture is directed around an inner wall of a separation chamber. The combination of the centrifugal forces acting on the air/oil mixture and contact between the air/oil mixture and the inner wall of the separation chamber causes much of the oil to separate from the air/oil mixture, thereby allowing gravity to draw most of the oil downwardly into a lower portion of the separation chamber and also allowing the air to separate from the oil and flow upwardly into an upper portion of the separation chamber to achieve primary separation.

In these conventional air compressor systems, the compressed air, along with some fine oil droplets or mist entrained therein, passes through a separator element placed within the upper portion of the separation chamber, thereby coalescing most of the remaining oil in the air stream to achieve secondary separation before the compressed air is transferred out of the separator tank. The coalesced oil pools in a bottom portion of the separator element and is returned to the airend of the compressor by a scavenging line.

SUMMARY OF THE INVENTION

Conventional air compressor systems as described above typically include a lid mounted on the separator tank to hold the separator element within the separation chamber of the separator tank. The separator element must be held in place because there is an upward force on the separator element due to the pressure differential between the wet side (outer) and dry side (inner) portions of the separator element. Conventional air compressor systems include an air exit port in the lid, and typically, a minimum pressure check valve (MPCV) assembly is operatively connected to the air exit port in the lid. After passing through the MPCV assembly, the compressed air is typically sent to an aftercooler, and then the cooled compressed air may be conveyed to pneumatic equipment and/or other tools. As can be appreciated by those skilled in the art, it is generally necessary to service or replace separator elements from time-to-time. In the conventional air compressor systems described above, before a separator element can be serviced or replaced, the air discharge hose and MPCV assembly, which usually includes associated fittings, must be disconnected from the lid. This increases the time required to service or replace the separator element. Thus, there is a need for an air compressor system which eliminates the necessity of disconnecting the air discharge hose and MPCV assembly from the separator tank prior to servicing or replacing a separator element.

The conventional way to remove oil from inside a separator element of the air compressor systems described above is to pass an independent scavenge tube through the lid mounted on the tank and down into an open area of the separator element. The scavenge tube extends to the bottom of the separator element and draws off the excess oil to prevent saturation of the separating media of the separator element. Positioning the scavenge tube through the lid and down into the open area of the separator element can be problematic. If the scavenge tube is too long, it may puncture the bottom of the separator element. If the scavenge tube is too short, it may not be sufficiently effective in removing the oil. In addition, before the separator element is replaced, the scavenge tube must be removed from the separator tank lid. Thus, there is a need for a scavenging device which is easy to install, which does not adversely affect the servicing or replacing of a separator element, and which also effectively removes oil from the bottom of the separator element.

The present invention provides in one aspect thereof, a separator tank having an air exit port in a side wall of the tank, rather than in the lid of the tank as is the case with many known designs. Air from an air/oil mixture flows into an upper portion of a separation chamber of the tank, through a separator element positioned within the upper portion of the separation chamber, and out the air exit port in the side wall of the tank. An MPCV assembly is operatively connected to the air exit port in the side wall of the tank. Because the MPCV assembly and air discharge hose are not attached to the lid of the separator tank, in order to service or replace the separator element, the lid mounted on the separator tank is simply removed or pivoted out of the way to allow access to the separator element, without having to first disconnect the discharge hose and MPCV assembly.

The present invention provides in another aspect thereof, a separator element hold down mechanism between the separator element and the lid to position the separator element within the separation chamber and in spaced relation from the lid. Air separated from the air/oil mixture will flow through the separator element, towards the lid, and out the air exit port in the side wall of the separator tank.

The present invention provides in another aspect thereof, a separator element oil scavenge device which draws oil up off of the bottom of the separator element, and which transports the scavenged oil through the side wall of a separator tank. In one embodiment of the present invention, the scavenge device includes a tube which is integrally formed with the separator element. Once the tube is securely attached to the separator element and an end of the tube is located at a predetermined position relative to the bottom of the separator element, there is no need for independent adjustment of the tube relative to the bottom of the separator element and, as a consequence, no risk of making the tube too long or too short.

Other features and advantages of the invention will become apparent to those skilled in the art upon review of the following detailed description, claims and drawings in which like numerals are used to designate like features.

BRIEF DESCRIPTION OF THE DRAWINGS

FIG. 2 is a perspective view of a separator tank shown in FIG. 1.

FIG. 3 is a cross-sectional view of a separator tank assembly shown in FIG. 1.

FIG. 4 is a partial cross-sectional view of a portion of an alternative embodiment of a separator tank assembly of the present invention.

Figure 1:
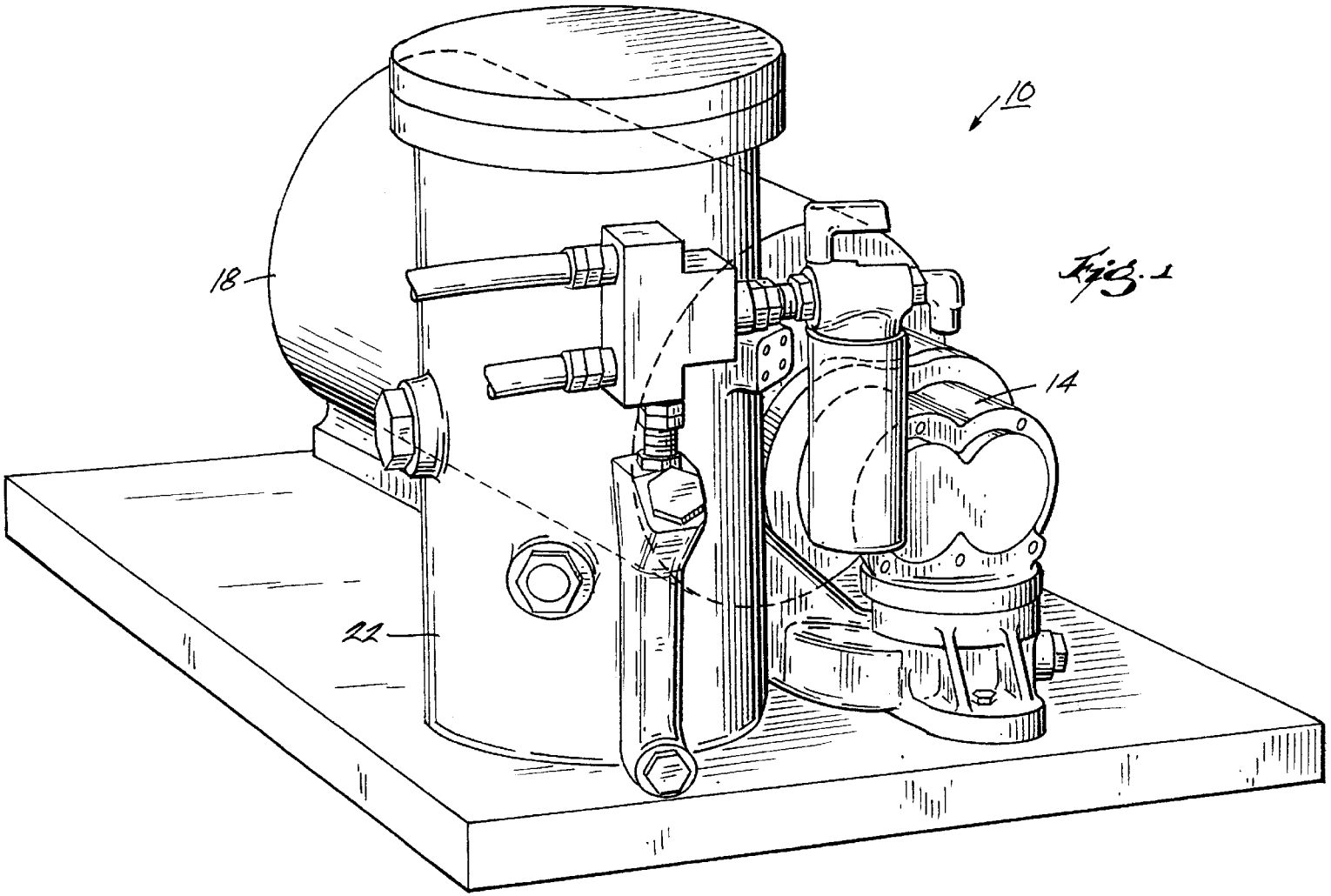
FIG. 1 is a perspective view of an air compressor system embodying the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof.

DETAILED DESCRIPTION OF THE PREFERRED EMBODIMENT

Illustrated in FIG. 1 is an air compressor system 10 embodying the present invention. It should be understood that the present invention is capable of use in other compressor systems, and the air compressor system 10 is merely shown and described as an example of one such system.

The air compressor system 10 illustrated in FIG. 1 includes a compressor 14, a motor 18, and a separator tank 22. Although the separator tank 22 as disclosed herein is used to separate oil from an air/oil mixture, it is contemplated that the separator tank 22 may be used to separate a volume of gas from any mixed media combination, including any gas/liquid combination. In addition, it is contemplated that the compressor 14 may be any suitable compressor, such as an oil-flooded air compressor. However, for the purposes of describing the preferred embodiment, the compressor 14 is a rotary screw compressor.

The separator tank 22 may be constructed of any number of suitable materials. However, in a preferred embodiment, the separator tank 22 is a cast separator tank. Air enters the compressor 14 and is compressed by rotary screws (not shown) found within the compressor 14. Oil is injected into the compressor 14 to lubricate the rotary screws and a gearbox (not shown) which drives the rotary screws. The oil further serves as a sealing means for the compressor 14. The compressed air and some of the oil travel out of the rotary screws through an airend discharge opening of the compressor and into an airend inlet opening 26 (FIG. 2) in the separator tank 22. The separator tank 22 serves to separate oil from the compressed air and also serves as an oil sump for the oil used to lubricate the rotary screws, the gearbox and other components. The compressed air and oil enter the separator tank 22 and are caused to undergo a cyclonic motion within the separator tank 22. As the compressed air and oil are flung around an inner surface of the separator tank 22, the oil will slide down the inner surface of the separator tank 22 and collect in the bottom of the separator tank 22, and the air will move up and out of the separator tank 22 for fisher filtering, cooling and ultimate use.

Referring to FIG. 3, the separator tank 22 includes a side wall 30 and defines a separation chamber 34 having a lower portion 38 and an upper portion 42. The lower portion 38 of the separation chamber 34 serves as an oil reservoir or sump for the oil that is separated from the air/oil mixture introduced into the separation chamber 34 via channel 46 (see also FIG. 2) during the primary separation process. A channel 50 communicates with the bottom of the lower portion 38 of the separation chamber 34. Pressure within the separator tank 22 forces the oil collected in the lower portion 38 of the separation chamber 34 to flow through the channel 50 and back to the compression chamber of the compressor 14 to lubricate the rotary screws, the gearbox and other components.

FIGS. 3–6 and 8–9 schematically illustrate separator elements 54 used in the secondary separation process. Although the illustrated separator elements 54 may have slightly different configurations, with reference to FIG. 9, each separator element 54 generally has a cylindrical body comprising inner 55 and outer 56 perforate metal shells, filter media 57 sandwiched between the shells 55 and 56, an open top 58, a closed bottom 62, and an internal passage (represented by arrow 64) where substantially oil-free compressed air flows from the separation chamber 34 of the separator tank 22. During the secondary separation process, oil pooled in the bottom 62 of the separator element 54 will be piped back to the compressor 14 via a scavenging device as described in detail below. It should be noted that the present invention is capable of use with many different separator elements, and the separator elements 54 are merely shown and described as examples of such separator elements.

Referring now to FIG. 3, the separator element 54 is placed within the upper portion 42 of the separation chamber 34. An annular flange 66 extends around the top portion 58 of the separator element 54. The separator tank 22 includes a ledge 70 which extends circumferentially around an inner surface 74 of the side wall 30 of the separator tank 22. The flange 66 of the separator element 54 rests on the ledge 70 of the side wall 30. It should be noted that when the separator tank 22 is a cast separator tank, it is preferable for the ledge 70 to be an integrally cast member of the separator tank. As previously explained, air from the air/oil mixture introduced into the separation chamber 34 will flow upwardly into the upper portion 42 of the separation chamber 34 and through the separator element 54.

The separator tank 22 includes an air exit port 78 in the side wall 30 of the separator tank 22 for the air from the air/oil mixture that flows through the separator element 54. An MPCV assembly 82 is operatively connected, preferably threadably connected, to the air exit port 78. Lid 86 is mounted on the separator tank 22. When it is desirable to service or replace the separator element 54, lid 86 is simply removed or pivoted out of the way to provide quick and easy access to the separator element 54, without having to first disconnect the MPCV assembly 82 from the air exit port 78.

In an alternative embodiment, a boss 90 (FIGS. 2 and 4) having a channel 94 (FIGS. 2 and 4) therethrough extends outwardly from the side wall 30 of the separator tank 22. The boss 90 is arranged so that the air exit port 78' (FIG. 4) in the side wall 30 aligns with the channel 94 to provide an air exit passageway 98 (FIG. 4) out of the upper portion 42 of the separation chamber 34. MPCV assembly 82 (FIG. 4) is operatively connected to the channel 94 of the boss 90. In a preferred embodiment, the separator tank 22 is a cast separator tank and the boss 90 is an integrally cast member of the separator tank 22.

Figure 8:
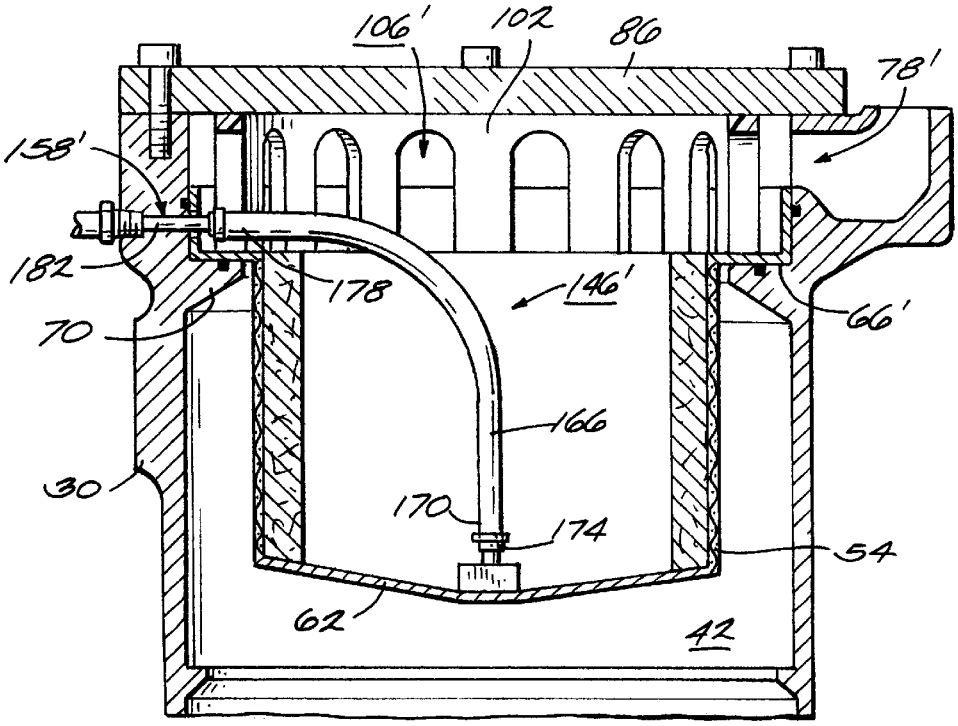
FIG. 8 is a partial cross-sectional view of a portion of an alternative embodiment of a separator tank assembly of the present invention.

Referring again to FIG. 3, during operation of the compressor system 10, an upwardly acting resultant force within the separation chamber 34 is applied against the bottom 62 of the separator element 54. Thus, a separator element hold down mechanism 102 is provided between the separator element 54 and the lid 86 to position and hold the separator element 54 within the separation chamber 34. The separator element hold down mechanism 102, which is in the shape of an annular spacer ring, engages the flange 66 (or flange 66' as shown in FIG. 8) of the separator element 54 to hold the separator element 54 against the ledge 70 on the side wall 30 when the lid 86 is closed. The separator element hold down mechanism 102 positions the separator element 54 away from the lid 86, and it also includes a plurality of apertures 106 (or 106' as shown in FIG. 8) or holes which allow the air to flow through the separator hold down mechanism 102 to reach the air exit port 78 (or 78' as shown in FIG. 8) in the side wall 30 of the separator tank 22. The separator element hold down mechanism according to the present invention may comprise many different shapes and configurations, so long as it functions to position and hold the separator element within the separation chamber, and so long as it allows the air which travels through the separator element to reach the air exit port in the side wall of the separator tank.

Figure 5:
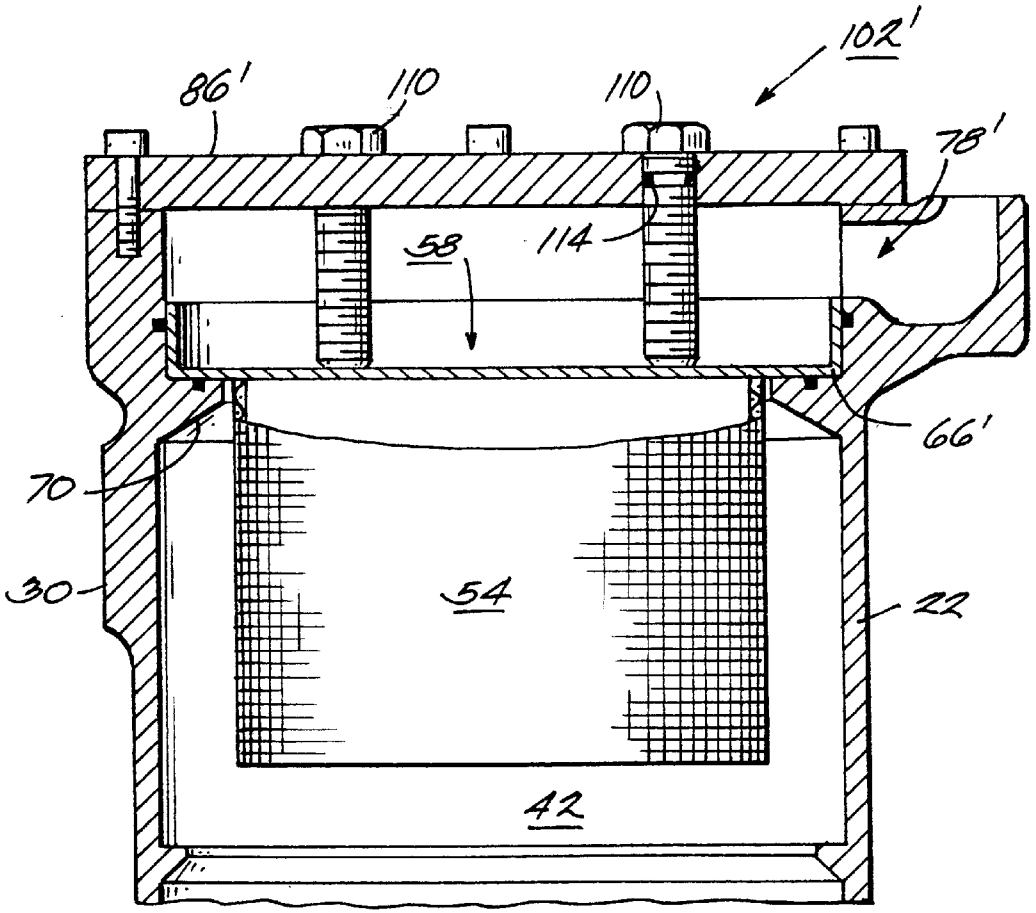
FIG. 5 is a partial cross-sectional view of a portion of an alternative embodiment of a separator tank assembly of the present invention.

For example, with reference to FIG. 5, the separator element hold down mechanism 102' includes a plurality of bolts 110 which threadably extend through the lid 86' and which engage the flange 66' of the separator element 54 to hold the separator element 54 against the ledge 70 on the side wall 30. Each bolt 110 includes an O-ring seal 114 between itself and the lid 86' to better seal the air space provided between the bottom of the lid 86 and the top 58 of the separator element 54. Air flowing up through the separator element 54 simply changes direction and flows out of the air exit port 78' in the side wall 30 of the separator tank 22.

Figure 6:
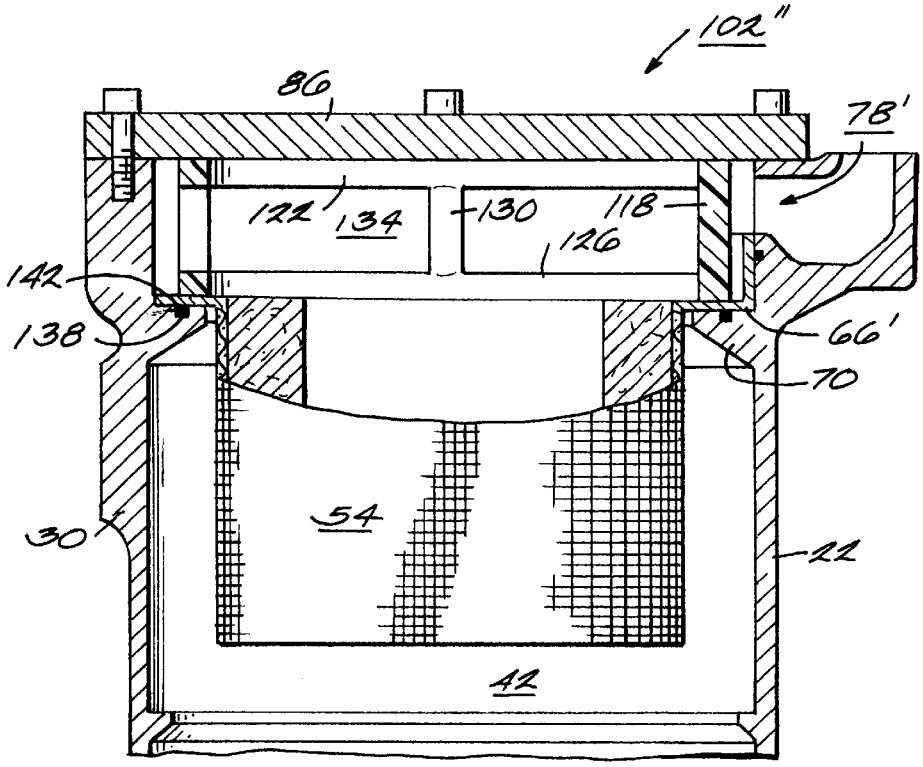
FIG. 6 is a partial cross-sectional view of a portion of an alternative embodiment of a separator tank assembly of the present invention.
Figure 7:
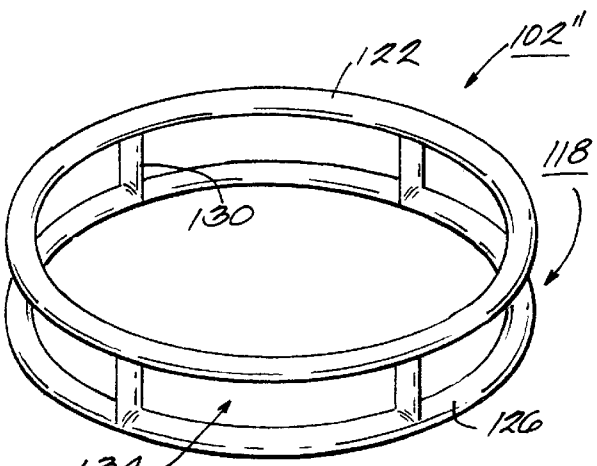
FIG. 7 is a perspective view of the separator element hold down mechanism of FIG. 6.

As another example, with reference to FIGS. 6–7, the separator element hold down mechanism 102" is a generally annular spacer ring 118 having a top ring 122, a bottom ring 126, and a plurality of columns 130 extending between the top 122 and bottom 126 rings, thereby defining a plurality of air passages 134. The spacer ring 118 engages the flange 66' of the separator element 54 to hold the separator element against the ledge 70 on the side wall 30 when the lid 86 is closed. Air flowing up through the separator element 54 passes through the air passages 134 on its way to the air exit port 78'. In an alternative embodiment, the annular spacer ring is a solid cast annular ring having an aperture therethrough to allow the air passing through the separator element to reach the air exit port.

Preferably, ledge 70 on the side wall 30 of the separator tank 22 includes an annular groove 138 for receiving an O-ring seal 142 (see, e.g., FIG. 6). The O-ring seal 142 is positioned between the flange 66' (or flange 66 as shown in FIG. 3) of the separator element 54 and the ledge 70 of the side wall 30 to provide an appropriate seal and to accommodate stack-up manufacturing/assembly tolerances in the separator tank assemblies shown in FIGS. 3–6 and 8–9.

As mentioned above and with reference to FIG. 9, oil mist coalesced by the secondary separator element 54 is drawn inward towards passage 64, runs down inner shell 55 and collects at the bottom 62 of the separator element 54. The coalesced oil is drawn out of the bottom 62 of the separator element 54 by a separator element oil scavenge device 146. The scavenged oil is piped back to the compressor 14 for use by the compressor 14.

Figure 9:
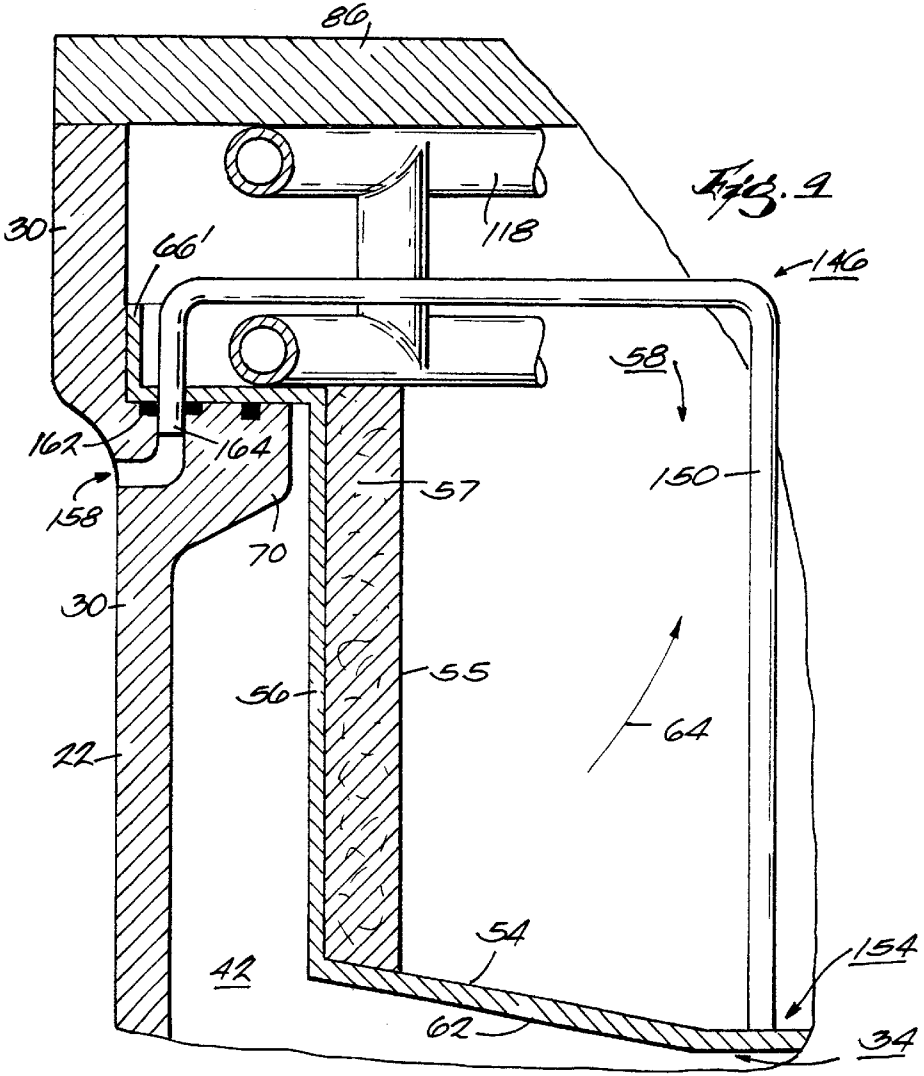
FIG. 9 is a partial cross-sectional view of a portion of an alternative embodiment of a separator tank assembly of the present invention.

With continued reference to FIG. 9, the separator element oil scavenge device 146 includes a scavenge tube or pipe 150. The tube is preferably a metal tube but, may be made of other suitable materials, such as plastic. One end 154 of the tube 150 is located near the bottom 62 of the separator element 54. The tube 150 extends up through the passage 64 of the separator element 54, and along and above the open end 58 of the separator element 54. Although not shown, a support member may extend across the open end 58 of the separator element 54. The tube 150 would then extend through the support member. The tube 150 extends back through the flange 66' of the separator element 54. The tube 150 also suitably extends through the spacer ring 118. The tube 150 is preferably tack welded to either or both of the flange 66' and support member (not shown) to locate the end 154 of the tube 150 a predetermined distance from the bottom 62 of the separator element 54. Because the tube 150 is incorporated into the structure of the separator element 54, during assembly of the separator tank 22, no independent adjustment of the scavenge tube 150 is necessary to ensure that the tube 150 is spaced an optimum distance from the bottom 62 of the separator element 54. A channel 158 is provided in the side wall 30 of the separator tank 22. The channel 158 opens through the ledge 70 on the side wall 30 and is adapted to receive a portion of the tube 150. An O-ring seal 162 is placed around end 164 of the tube 150 which extends through the flange 66'. The channel 158 is also adapted to receive the O-ring seal 162 to provide an appropriate seal.

Upon assembly of the separator tank 22, the separator element 54 is placed within the separation chamber 34 such that the end 164 of the tube 150 extending through the flange 66' is received by the channel 158. As shown in FIG. 9, the tube 150 may be used as a handle for placing and removing the separator element 54 into and from the separator tank 22. To replace the separator element 54, the lid 86 is opened and the separator element 54 is removed without having to first disassemble the scavenge device 146. To reinstall a separator element 54 into the separation chamber 34, a separator element 54 and its securely attached scavenge device is simply deposited within the separation chamber 34 as described above. Once the lid 86 is closed, the separator hold down mechanism will hold the separator element in place.

FIG. 8 illustrates an alternative separator element oil scavenge device 146' which includes a scavenge tube 166, such as a Teflon tube. One end 170 of the tube 166 is connected to a fitting 174 found in the bottom 62 of the separator element 54 and the other end 178 of the tube 166 is connected to a fitting 182 extending through a channel 158' in the side wall 30 of the separator tank 22.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. An air compressor system comprising:

a compressor;

a separator tank which receives an air/oil mixture from said compressor, said separator tank having a side wall and defining a separation chamber having a lower portion and an upper portion, said separator tank including an air exit port in said side wall in said upper portion of said separation chamber, such that oil from the air/oil mixture introduced into said separation chamber collects in said lower portion of said separation chamber and air from the air/oil mixture flows into said upper portion of said separation chamber;

a separator element placed within said upper portion of said separation chamber;

a lid mounted on said separator tank; and a separator element hold down mechanism between said separator element and said lid to position said separator element within said separation chamber and in spaced relation from said lid, such that the air separated from the air/oil mixture flows through said separator element, towards said lid, and out said air exit port in said side wall of said separator tank wherein said separator element hold down mechanism is a spacer device having an aperture extending therethrough, such that the air separated from the air/oil mixture flows through said aperture of said spacer device on its way to said air exit port in said side wall of said separator tank.

2. An air compressor system according to claim 1, further comprising a minimum pressure check valve operatively connected to said air exit port in said side wall of said separator tank.

3. An air compressor system according to claim 1, wherein said separator tank further includes a boss having a channel therethrough, said boss extending outwardly from said side wall of said separator tank so that said air exit port in said side wall of said separator tank is aligned with said channel in said boss to provide an air exit passageway out of said upper portion of said separation chamber.

4. An air compressor system according to claim 3, wherein said separator tank is a cast separator tank and said boss is an integrally cast member of said separator tank.

5. An air compressor system according to claim 4, further comprising a minimum pressure check valve operatively connected to said channel of said boss.

6. An air compressor system according to claim 1, wherein said separator element hold down mechanism includes at least one bolt which threadably extends through said lid and which engages said separator element.

7. An air compressor system according to claim 6, further comprising at least one O-ring seal, one for each bolt, each O-ring seal placed around a respective bolt and in contact with said lid.

8. An air compressor system according to claim 1, further comprising a ledge which extends around an inner wall of said side wall of said separator tank in said upper portion of said separation chamber, and wherein said separator element includes a top end, a bottom end and a flange extending around said top end, said flange of said separator element resting on said ledge on said inner wall of said side wall of said separator tank, said separator element hold down mechanism engaging said flange of said separator element to hold said separator element against said ledge.

9. An air compressor system according to claim 1, wherein said ledge on said inner wall of said side wall of said separator tank includes a groove for receiving an O-ring seal, said O-ring seal being positioned between said flange of said separator element and said ledge on said inner wall of said side wall of said separator tank to provide an appropriate seal and to accommodate stack-up tolerances in said separator tank.

10. An air compressor system according to claim 9, wherein said separator tank is a cast separator tank and said ledge on said inner wall of said side wall of said separator tank is an integrally cast member of said separator tank.

11. An air compressor system according to claim 1, wherein said spacer device is a solid cast annular ring.

12. An air compressor system comprising:

a compressor;

a separator tank which receives an air/oil mixture from said compressor, said separator tank having a side wall and defining a separation chamber having a lower portion and an upper portion, said separator tank including a channel extending through said side wall;

a separator element placed within said upper portion of said separation chamber, said separator element including an upper portion and a bottom portion;

a lid mounted on said separator tank; and a separator element oil scavenge device adapted to retrieve oil which is separated from the air/oil mixture introduced into said separation chamber and which passes through said separator element and collects in said bottom portion of said separator element, said scavenge device also adapted to transport the scavenged oil through said channel in said side wall of said separator tank.

13. An air compressor system according to claim 12, wherein said scavenge device includes a tube having a first end and a second end, such that said scavenged oil first flows into said first end of said tube and out of said second end of said tube.

14. An air compressor system according to claim 13, wherein said tube is securely attached to said separator element, so that said separator element and said tube can be positioned into or removed from said upper portion of said separation chamber as a single unit.

15. An air compressor system according to claim 14, further comprising a ledge which extends circumferentially around an inner wall of said side wall of said separator tank in said upper portion of said separation chamber, and wherein said channel in said side wall of said separator tank opens through said ledge on said inner wall of said side wall of said separator tank, and wherein said separator element includes a flange extending around said upper portion, said flange of said separator element resting on said ledge on said inner wall of said side wall of said separator tank, and wherein said tube extends from said bottom portion of said separator element through said upper portion of said separator element and back through said flange of said separator element, such that a portion of said tube extending through said flange of said separator element is received by a portion of said channel that opens through said ledge in said side wall of said separator tank.

16. An air compressor system according to claim 15, wherein said ledge on said inner wall of said side wall of said separator tank includes a groove for receiving an O-ring seal, said O-ring seal being positioned between said flange of said separator element and said ledge on said inner wall of said side wall of said separator tank to provide an appropriate seal and to accommodate stack-up tolerances in said separator tank.

17. An air compressor system according to claim 16, further comprising an O-ring seal which is positioned around said portion of said tube extending through said flange of said separator element and which is received by said channel in said side wall of said separator tank.

18. An air compressor system according to claim 12, wherein said scavenge device includes a first fitting located in said bottom portion of said separator element and a second fitting associated with said channel in said side wall of said separator tank, said scavenge device further including a tube having a first end connected to said first fitting and a second end connected to said second fitting.

19. An air compressor system comprising:

a compressor;

a cast separator tank which receives an air/oil mixture from said compressor, said cast separator tank having a side wall and defining a separation chamber having a lower portion and an upper portion, said cast separator tank including an air exit port in said side wall in said upper portion of said separation chamber, and said cast separator tank further including a channel extending through said side wall;

a separator element placed within said upper portion of said separation chamber, said separator element including a top portion and a bottom portion;

a lid mounted on said separator tank;

a separator element hold down mechanism between said separator element and said lid to position said separator element within said separation chamber and in spaced relation from said lid, such that air separated from the air/oil mixture introduced into said separation chamber flows into said upper portion of said separation chamber, through said separator element, towards said lid, and out said air exit port in said side wall of said cast separator tank; and a separator element oil scavenge device adapted to retrieve oil which is separated from the air/oil mixture and which passes through said separator element and collects in said bottom portion of said separator element, said scavenge device also adapted to transport the scavenged oil through said channel in said side wall of said cast separator tank.

20. An air compressor system according to claim 19, wherein said cast separator tank further includes an integrally cast boss having a channel therethrough, said boss extending outwardly from said side wall of said cast separator tank so that said air exit port in said side wall of said cast separator tank is aligned with said channel in said boss to provide an air exit passageway out of said upper portion of said separation chamber.

21. An air compressor system according to claim 20, further comprising a minimum pressure check valve operatively connected to said channel of said boss.

22. An air compressor system according to claim 19, further comprising a ledge which extends around an inner wall of said side wall of said cast separator tank in said upper portion of said separation chamber, said ledge being an integrally cast member of said cast separator tank and said ledge including a groove having an O-ring seal placed therein, and wherein said separator element includes a flange extending around said top portion, said flange of said separator element resting on said ledge on said inner wall of said side wall of said cast separator tank, such that said O-ring seal is positioned between said flange of said separator element and said ledge on said inner wall of said side wall of said cast separator tank to provide an appropriate seal and to accommodate stack-up tolerances in said cast separator tank, and wherein said separator hold down mechanism is a spacer element having an aperture extending therethrough, said spacer element engaging said flange of said separator element to hold said separator element against said ledge, and wherein air separated from the air/oil mixture flows through said aperture of said spacer device on its way to said air exit port in said side wall of said cast separator tank.

23. An air compressor system according to claim 19, further comprising a ledge which extends circumferentially around an inner wall of said side wall of said cast separator tank in said upper portion of said separation chamber, and wherein said channel in said side wall of said cast separator tank opens through said ledge on said inner wall of said side wall of said cast separator tank, and wherein said separator element includes a flange extending around said top portion, said flange of said separator element resting on said ledge on said inner wall of said side wall of said cast separator tank, and wherein said scavenge device includes a tube which is securely attached to said separator element and which extends from said bottom portion of said separator element through said top portion of said separator element and back through said flange of said separator element, such that a portion of said tube extending through said flange of said separator element is received by said channel in said side wall of said cast separator tank opening through said ledge, and wherein said air/oil separator further includes an O-ring seal which is positioned around said portion of said tub extending through said flange of said separator element and which is received by a portion of said channel that opens through said ledge in said side wall of said cast separator tank.

24. A compressor system comprising:

an oil-flooded air compressor having an airend discharge opening;

a motor operatively connected to said compressor;

a separator tank having a side wall and defining a separation chamber having a lower portion and an upper portion, said separator tank including an airend inlet opening which communicates with said airend discharge opening of said compressor to allow an air/oil mixture exiting said airend discharge opening of said compressor to enter said separation chamber, said separator tank fewer including an air exit port in said side wall in said upper portion of said separation chamber, said separator tank configured such that oil from the air/oil mixture introduced into said separation chamber collects in said lower portion of said separation chamber and air from the air/oil mixture flows into said upper portion of said separation chamber;

a separator element placed within said upper portion of said separation chamber;

a lid mounted on said tank; and a separator element hold down mechanism between said separator element and said lid to position said separator element within said separation chamber and in spaced relation from said lid, such that the air separated from the air/oil mixture flows through said separator element towards said id, and out said air exit port in said side wall of said separator tank wherein said separator element hold down mechanism is a spacer device having an aperture extending therethrough, such that the air separated from the air/oil mixture flows through said aperture of said spacer device on its way to said air exit port in said side wall of said tank.

25. A compressor system according to claim 24, wherein said separator tank further includes a boss having a channel therethrough, said boss extending outwardly from said side wall of said separator tank so that said air exit port in said side wall of said separator tank is aligned with said channel in said boss to provide an air exit passageway out of said upper portion of said separation chamber.

26. A compressor system according to claim 25, wherein said separator tank is a cast tank and said boss is an integrally cast member of said tank.

27. A compressor system comprising:

an oil-flooded air compressor having an airend discharge opening;

a motor operatively connected to said compressor;

a separator tank having a side wall and defining a separation chamber having a lower portion and an upper portion, said separator tank including an airend inlet opening which communicates with said airend discharge opening of said compressor to allow an air/oil mixture exiting said airend discharge opening of said compressor to enter said separation chamber, said separator tank further including a channel extending through said side wall of said separator tank;

a separator element placed within said upper portion of said separation chamber, said separator element including an upper portion and a bottom portion;

a lid mounted on said separator tank; and a separator element oil scavenger device adapted to retrieve oil which is separated from the air/oil mixture introduced into said separation chamber and which passes through said separator element and collects in said bottom portion of said separator element, said scavenger device also adapted to transport the scavenged oil through said channel in said At side wall of said separator tank.

28. A compressor system according to claim 27, wherein said separator tank further includes a ledge which extends circumferentially around an inner wall of said side wall of said separator tank in said upper portion of said separation chamber, and wherein said channel in said side wall of said separator tank opens through said ledge on said inner wall of said side wall of said separator tank, and wherein said separator element includes a flange extending around said upper portion, said flange of said separator element resting on said ledge on said inner wall of said side wall of said separator tank, and wherein said scavenger device includes a tube which is securely attached to said separator element, said tube extending from said bottom portion of said separator element through said upper portion of said separator element and back through said flange of said separator element, such that a portion of said tube extending through said flange of said separator element is received by a portion of said channel that opens through said ledge in said side wall of said tank.

29. A compressor system according to claim 28, wherein said tube provides a handle for placing and removing said separator element into and from said separator tank.

* * * * *